US007959748B2

(12) United States Patent
Kim et al.

(10) Patent No.: US 7,959,748 B2
(45) Date of Patent: Jun. 14, 2011

(54) METHOD OF MANUFACTURING NI-BASED SUPERALLOY COMPONENT FOR GAS TURBINE USING ONE-STEP PROCESS OF HOT ISOSTATIC PRESSING AND HEAT TREATMENT AND COMPONENT MANUFACTURED THEREBY

(75) Inventors: Min-Tae Kim, Daejeon (KR); Sung-Yong Chang, Daejeon (KR); Jong-Bum Won, Daejeon (KR); Won-Young Oh, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 42 days.

(21) Appl. No.: 11/930,347

(22) Filed: Oct. 31, 2007

(65) Prior Publication Data

US 2009/0148337 A1 Jun. 11, 2009

(30) Foreign Application Priority Data

Oct. 31, 2006 (KR) ..... 10-2006-0106435

(51) Int. Cl.
*C22F 1/10* (2006.01)

(52) U.S. Cl. ..... 148/675; 148/555

(58) Field of Classification Search ..... 148/426–429, 148/555–556, 559, 675–677; 420/441–460; 419/42, 49, 54
See application file for complete search history.

(56) References Cited

U.S. PATENT DOCUMENTS

| | | | | |
|---|---|---|---|---|
| 5,009,704 | A * | 4/1991 | Banik | 75/238 |
| 5,527,403 | A * | 6/1996 | Schirra et al. | 148/675 |
| 2006/0016527 | A1 * | 1/2006 | Yoshioka et al. | 148/671 |

* cited by examiner

*Primary Examiner* — Stanley Silverman
*Assistant Examiner* — Brian Walck
(74) *Attorney, Agent, or Firm* — Sughrue Mion, PLLC

(57) ABSTRACT

Disclosed herein are a method of manufacturing a Ni-based superalloy component for a gas turbine using a one-step process of hot isostatic pressing (HIP) and heat treatment, and a component manufactured by the method. In the method, an HIP process and a heat treatment process, which have been performed to manufacture or repair a Ni-based superalloy component for a gas turbine, are performed as a one-step process using an HIP apparatus. Thus, component defects, such as micropores and microcracks, which are generated when casting, welding, or brazing the Ni-based superalloy component for a gas turbine used for a combined cycle thermal power plant or airplane, can be cured using an HIP apparatus at high temperature and high pressure and, at the same time, the physical properties of the Ni-based superalloy component can be optimized using the heat treatment process.

1 Claim, 14 Drawing Sheets

3H12-1090

| PROCESSING TEMPERATURE : 1330°C | PROCESSING TEMPERATURE : 1340°C |
|---|---|
|  |  |
| FIRST CONDITAION : ATMOSPHERIC PRESSURE | |

| PROCESSING TEMPERATURE : 1330°C | PROCESSING TEMPERATURE : 1340°C |
|---|---|
|  |  |
| SECOND CONDITATION : AFTER RAISING TEMPERATURE, RASING PRESSURE | |

| PROCESSING TEMPERATURE : 1330°C | PROCESSING TEMPERATURE : 1340°C |
|---|---|
|  |  |
| RAISING TEMPERATURE AND PRESSURE SIMULTANEOUSLY | |

DENDRITES

INTERDENDRITIC REGIONS

1H11

1H21

1H12

1H22

2H11

2H21

2H12

2H22

3H12-1090

3H21-1000

3H21-1020

3H21-1050np

4H11

4H12

5H11-1030

5H12-1030

METHOD OF MANUFACTURING NI-BASED SUPERALLOY COMPONENT FOR GAS TURBINE USING ONE-STEP PROCESS OF HOT ISOSTATIC PRESSING AND HEAT TREATMENT AND COMPONENT MANUFACTURED THEREBY

CROSS-REFERENCE TO RELATED APPLICATION

This application claims priority to and the benefit of Korean Patent Application No. 10-2006-0106435, filed on Oct. 31, 2006, the disclosure of which is incorporated herein by reference in its entirety.

BACKGROUND OF THE INVENTION

1. Field of the Invention

The present invention relates to a method of manufacturing a Ni-based superalloy component for a gas turbine using a one-step process of hot isostatic pressing (HIP) and heat treatment, and a component manufactured thereby and, more particularly, to a method of manufacturing a Ni-based superalloy component for a gas turbine using a one-step process of HIP and heat treatment, in which an HIP process and a heat treatment process, which have been typically separately performed to manufacture or repair the Ni-based superalloy component for a gas turbine, are performed as a one-step process using an HIP apparatus, and a component manufactured by the method. Thus, component defects, such as micropores or microcracks, which are generated when casting, welding, or brazing the Ni-based superalloy component for a gas turbine used for a combined cycle thermal power plant or airplane, can be cured using an HIP apparatus at a high temperature and, at the same time, the physical properties of the Ni-based superalloy component can be optimized using the heat treatment process.

2. Description of the Related Art

Most hot gas components used for gas turbines that directly run on gas generated by burning fossil fuels are formed of Ni-based superalloy materials (e.g., GTD-111) by a precision casting process. When a hot gas component used for a predetermined time is slightly damaged, the damaged portions are repaired using a welding or brazing method to reuse the hot gas component. However, since the repaired hot gas component may not be perfect due to cast defects (e.g., micropores) or welding cracks, these defects are cured using a hot isostatic pressing (HIP) apparatus to densify the structure of the hot gas component.

Also, the hot gas components for gas turbines, which are cast or repaired using a welding or brazing method, are subjected to a series of heat treatments in order to optimize physical properties (e.g., high-temperature tensile strength and creep resistance characteristics) of the Ni-based superalloy material. For example, Rene 80, which is a Ni-based superalloy, undergoes the following four-step heat treatment.

[Step 1] Rene 80 is vacuum processed at a temperature of about 2175 to 2225° F. (about 1191 to 1218° C.) for 2 hours, and then furnace-cooled in a vacuum atmosphere or in an Ar or He atmosphere to a temperature of about 1975 to 2025° F. (about 1079 to 1107° C.) within 10 minutes.

[Step 2] Rene 80 is vacuum processed at a temperature of about 1975 to 2025° F. (about 1079 to 1107° C.) for 4 hours, furnace-cooled in a vacuum atmosphere or in an Ar or He atmosphere to a temperature of about 1200° F. (about 649° C.) within 60 minutes, and then maintained at a temperature of about 1200° F. (about 649° C.) for 10 minutes.

[Step 3] Rene 80 is heated in a vacuum atmosphere to a temperature of about 1925° F. (about 1052° C.), maintained in a vacuum atmosphere or in an Ar or He atmosphere at a temperature of about 1900 to 1950° F. (about 1038 to 1066° C.) for 2 to 12 hours, cooled to a temperature of about 1200° F. (about 649° C.) within 15 to 60 minutes, and then maintained for 10 minutes.

[Step 4] Rene 80 is heated in a vacuum atmosphere or in an Ar or He atmosphere to a temperature of about 1550° F. (about 843° C.), maintained at a temperature of about 1525 to 1575° F. (about 829 to 857° C.) for 16 hours, and then furnace-cooled or air-cooled to a room temperature.

The foregoing heat treatment is carried out to control high-temperature physical properties of the Ni-based superalloy material, especially the shape and size of a gamma prime phase which is a high-temperature precipitation phase.

FIGS. 1A and 1B are scanning electron microscope (SEM) photographs showing dendritic and interdendritic microstructures of Ni-based superalloy components treated by a conventional heat treatment. Referring to FIG. 1A, it can be seen that square-shaped gamma-prime phases with a size of about 0.4 μm are uniformly distributed. The dendritic microstructures shown in FIG. 1A are obtained by processing the cast Ni-based superalloy using the conventional heat treatment.

Meanwhile, an HIP process is a commercially available process that is simply performed at predetermined temperature and pressure (e.g., 1190° C. and 100 MPa) for several hours. The microstructures of a material processed using the HIP process are quite different from those shown in FIGS. 1A and 1B.

For example, after a component obtained by casting and heat treating a Ni-based superalloy is used over a long period, the gamma prime phases become slightly rounded as shown in FIG. 2A. Although the gamma prime phases are changed into microstructures as shown in FIG. 2B when treated by the commercially available HIP process, they are quite different from the microstructures shown in FIGS. 1A and 1B.

Accordingly, in order to optimize the physical properties of the Ni-based superalloy even after performing the HIP process, the Ni-based superalloy is subjected to an additional heat treatment to obtain the microstructures shown in FIGS. 1A and 1B, in the same manner as when the Ni-based superalloy is cast. Accordingly, the conventional, commercially practiced, HIP process and heat treatment are separately performed. In most cases, the HIP process is followed by the heat treatment.

Conventionally, the time and manpower required to manufacture the hot gas components increase due to the two-step process including the HIP process and the heat treatment. Moreover, the unit cost of products increases since separate equipment is required for the HIP process and the heat treatment. Furthermore, the process of manufacturing or repairing the component is extended, thus increasing the failure rate.

SUMMARY OF THE INVENTION

Accordingly, the present invention provides a method of manufacturing a Ni-based superalloy component for a gas turbine using a one-step process of hot isostatic pressing (HIP) and heat treatment, in which a conventional HIP process is improved to effectively remove fine defects, which are caused during manufacture or repair of the Ni-based superalloy component for a gas turbine, at high temperature and high pressure and, at the same time, optimize the physical properties of the Ni-based superalloy component.

Moreover, the present invention provides a one-step process of HIP and heat treatment by which the physical properties of a Ni-based superalloy component can be improved compared with a conventional simple heat treatment process.

Furthermore, the present invention provides a Ni-based superalloy component for a gas turbine, which is processed with a one-step process of HIP and heat treatment so that it is freed from fine defects and has optimized physical properties.

In accordance with an aspect of the present invention, there is provided a method of manufacturing a Ni-based superalloy component for a gas turbine using a one-step process of HIP and heat treatment. The method includes simultaneously performing an HIP process and a heat treatment process as a one-step process on a Ni-based superalloy using an HIP apparatus under high-temperature and high-pressure conditions.

The one-step process of HIP and heat treatment for manufacturing a Ni-based superalloy component for a gas turbine according to the present invention optimizes the process temperature and time to obtain excellent physical properties by controlling the precipitation of gamma prime phases, which are hardened at high temperatures, during an HIP process after casting or repairing the Ni-based superalloy component for a gas turbine.

In the present invention, the high-temperature condition comprises a multistep process, preferably, a two-step process, in which the HIP process and the heat treatment process are carried out simultaneously as the one-step process. For example, the high-temperature condition is maintained at about 1200 to 1300° C., more preferably, at about 1210 to 1250° C. for 1 to 3 hours in a first step, and maintained at about 1000 to 1200° C. for 1 to 3 hours in a second step. As a result, the Ni-based superalloy component may have good physical properties.

Here, the reason why the high-temperature condition process comprises a multistep process, preferably, a two-step process is to appropriately form gamma prime (γ') precipitation phases, thus optimizing the physical properties of the Ni-based superalloy component.

If the temperature condition in the first step is maintained lower than the above-described temperature, γ' phases contained in a Ni-based superalloy before treatment may be incompletely melted and nonuniformly distributed, and thus it is difficult to control the precipitation of γ' phases in the second step. Contrarily, if the temperature condition in the first step is maintained higher than the above-described temperature, the Ni-based superalloy may partially melt. Further, if the temperature condition of the first step is maintained for too short time, the Ni-based superalloy may not be completely uniformized, whereas, if the temperature condition of the first step is maintained for too long time, the manufacturing process of the Ni-based superalloy component may be costly.

Moreover, if the temperature condition of the second step is maintained lower than the above-described temperature, "γ'" precipitation phases may be insufficiently generated to degrade the physical properties of the Ni-based superalloy component. Contrarily, if the temperature condition of the second step is maintained higher than the above-described temperature, the γ' precipitation phases may be excessively grown to adversely affect the physical properties of the Ni-based superalloy component. Further, if the temperature condition of the first step is maintained for too short time, the γ' precipitation phases may be insufficiently generated, whereas, if the temperature condition of the first step is maintained for too long time, the γ' precipitation phases may be excessively generated to degrade mechanical properties of the Ni-based superalloy component.

Meanwhile, it is preferable that the high-pressure condition be maintained at about 1000 to 1500 atmospheric pressure. If the pressure condition is too low, it is difficult to remove casting and welding defects from the Ni-based superalloy component, whereas, if the pressure condition is to high, the increase of the effects may be insignificant. Accordingly, it is preferable to maintain the above-described range.

As described above, according to the present invention, the Ni-based superalloy component is manufactured by processing a Ni-based superalloy material using a one-step process of HIP and heat treatment under appropriate process conditions. Accordingly, it is possible to manufacture and repair the Ni-based superalloy component for a gas turbine with optimized and excellent physical properties.

In particular, the one-step process of HIP and heat treatment may be performed using an HIP apparatus at high temperature and high pressure. In the event that the Ni-based superalloy component is processed with the one-step process of HIP and heat treatment, after the Ni-based superalloy component for a gas turbine is cast or repaired by welding, it is possible to control the precipitation of γ' phases having high-temperature creep resistance characteristics and fatigue resistance characteristics by increasing the strength of the Ni-based superalloy material at a high temperature. Moreover, it is possible to remove the defects from the Ni-based superalloy material, thus improving the durability of the Ni-based superalloy component.

The foregoing effects of the present invention can be attained by optimizing the process temperature and time in a one-step process of HIP and heat treatment.

Accordingly, the present invention includes a component for a gas turbine, which is manufactured by the above-described method according to the present invention. The component for a gas turbine may be exemplified by a first blade and a bucket, but the present invention is not limited thereto and can be applied to manufacture and repair a variety of components.

Particularly, the method according to the present invention can be employed to cure cast defects or solidification cracks, which are generated during a casting, welding, or brazing process, by processing a Ni-based superalloy component, for example, using an HIP apparatus at high temperature and high pressure after casting or overlay-welding the Ni-based superalloy component.

BRIEF DESCRIPTION OF THE DRAWINGS

The above and other features of the present invention will be described in reference to certain exemplary embodiments thereof with reference to the attached drawings in which.

DETAILED DESCRIPTION OF THE INVENTION

Hereinafter, the present invention will be described in more detail with reference to Examples; however, the examples are provided so that those skilled in the art can sufficiently understand the present invention, but can be modified in various forms and the scope of the present invention is not limited to the preferred examples.

Example 1

Preliminary Experiment: High-Pressure Melting Test

The base material used in the present Example was a GTD-111 superalloy casting material, which is a Ni-based superalloy the same as a material for a GE 7FA 1st blade, a 1300° C. gas turbine, which is being currently operated in South Korea. The GTD-111 superalloy material was cast to have a one-directional rod-shaped structure with a diameter of 15 mm and a length of 200 mm and heat treated under an atmospheric pressure. The compositions of the GTD-111 superalloy are shown in Table 1.

TABLE 1

(Unit: wt %)

| | Ni | Cr | Co | Ti | W | Al | Ta | Mo | Fe | C | B |
|---|---|---|---|---|---|---|---|---|---|---|---|
| GTD-111 | Residual | 13.5 | 9.5 | 4.76 | 3.84 | 3.6 | 2.7 | 1.53 | 0.23 | 0.09 | 0.01 |

Figure 3:
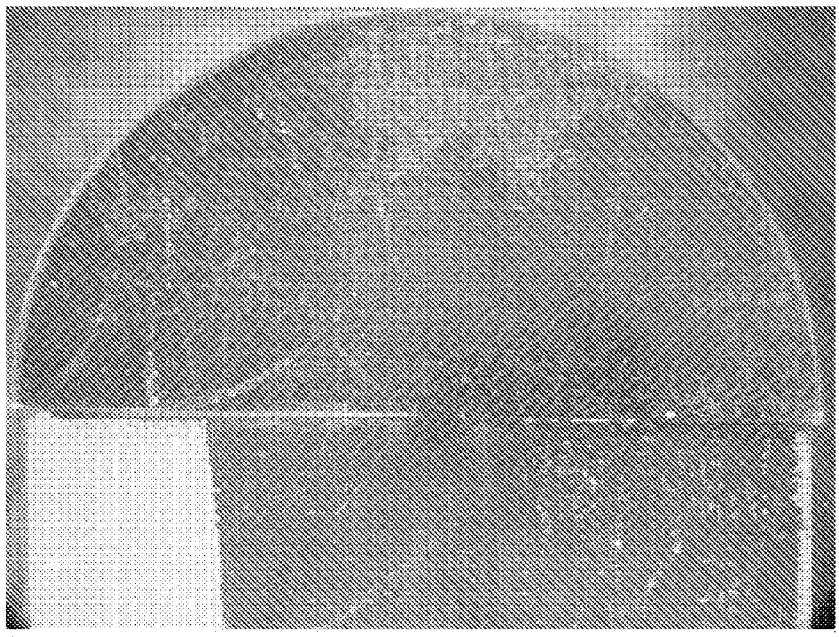
FIG. 3 is an optical microscope photograph showing the cross-section of a one-directional GTD-111 superalloy, wherein an upper portion is cut in a circumferential direction, i.e., in a vertical direction to a one-directional solidified structure, and a lower portion is cut in an axial direction.

FIG. 3 is an optical microscope photograph showing the cross-section of the one-directional GTD-111 superalloy. In FIG. 3, an upper portion is cut in a circumferential direction, i.e., in a vertical direction to a one-directional solidified structure, and a lower portion is cut in an axial direction. Referring to FIG. 3, it can be seen that the one-directional solidified structure is well developed.

Figure 4:
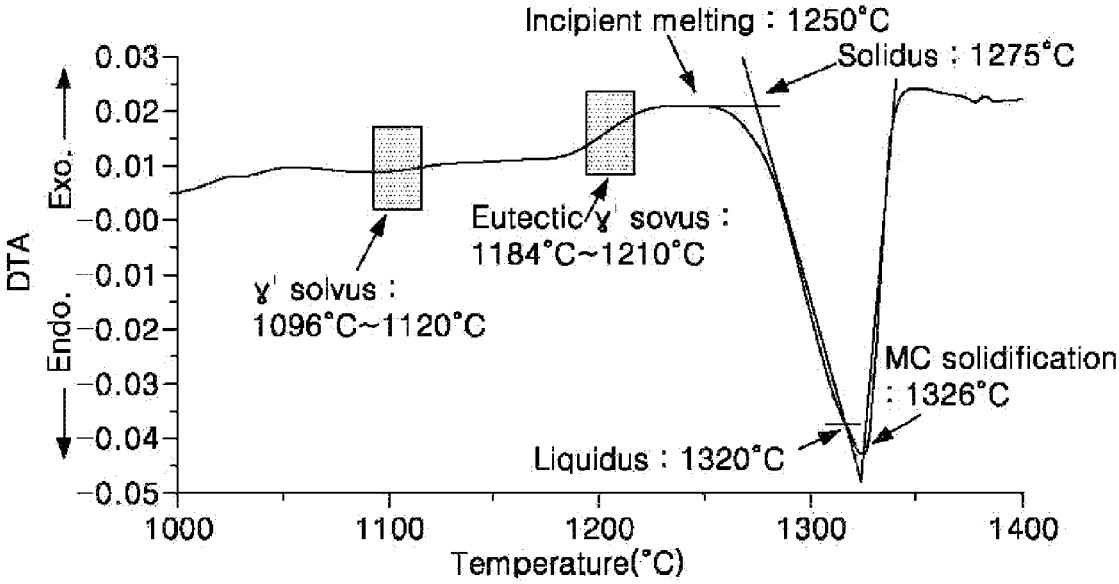
FIG. 4 is a graph showing the results of a differential thermal analysis (DTA) of the one-directional GTD-111 superalloy.

FIG. 4 is a graph showing the results of a differential thermal analysis (DTA) of the one-directional GTD-111 superalloy.

In order to examine the influence of an HIP process on the one-directional solidified structure of the GTD-111 superalloy cast in one direction, the GTD-111 superalloy was treated using an HIP apparatus with specifications shown in Table 2 at a constant pressure of 120 MPa and at temperatures above the liquidus temperature (1320° C.) of the GTD-111 superalloy, that is, at temperatures of 1330 and 1340° C., respectively, and the structural changes in the GTD-111 superalloy were observed.

During the HIP process, the GTD-111 superalloy was heated to a target temperature at a rate of 10° C./min, maintained for 4 hours, and rapidly cooled by argon quenching to examine the influence of the process temperature on the structure of the GTD-111 superalloy. The samples were treated under the following three conditions.

First condition: The samples were maintained at a process temperature by applying no pressure for 4 hours.

Second condition: The samples were heated to a process temperature and maintained for 10 minutes, and the pressure was increased to a predetermined pressure. Then, the samples were maintained at the process pressure for 4 hours.

Third condition: The temperature and pressure were simultaneously increased and then the samples were maintained at the increased temperature and pressure for 4 hours.

TABLE 2

| Item | Contents |
|---|---|
| Manufacturer | ABB(Sweden) |
| Container size | 1124(O.D) × 700(I.D) × 3,285(O.H) × 2,171(I.H) |
| Operation size (Max.) | 75(Outer diameter) × 890(Height) |
| Operation temperature (Max.) | 2,000° C. |
| Pressure (Max.) | 200 Mpa |
| Operating fluid | Ar |
| Heat element | SiC Heater 21 ea(3 Zone) |
| Loading type | Top Loading and Closure |

In order to confirm the changes in microstructures under each of the three conditions, the samples were polished using sandpaper 2000 times and polished using 6, 3, 1, and 0.25 μm diamond suspensions. The polished samples were electrolytic-etched using a solution containing 170 ml of distilled water, 20 ml of nitric acid, and 10 ml of glacial acetic acid at a voltage of 1.5 V for 1 minute and 10 seconds, and the structures of the samples were observed using a metallurgical microscope.

Figure 5A:
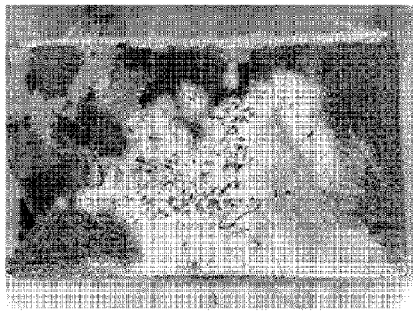
FIGS. 5A to 5C are optical microscope photographs showing the cross-sections of GTD-111 superalloys obtained after performing an HIP process according to Example 1 under different process conditions.
Figure 5A:
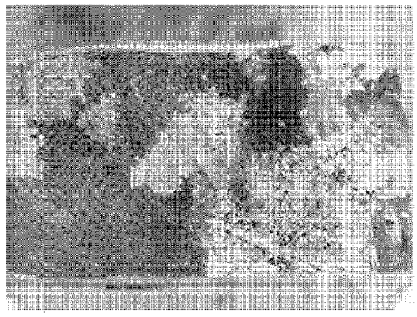
Figure 5B:
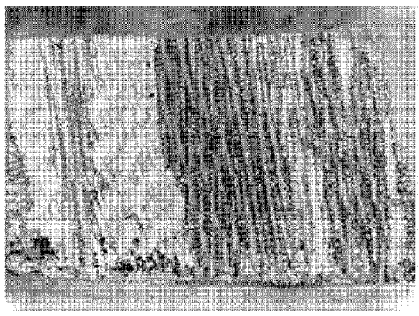
Figure 5B:
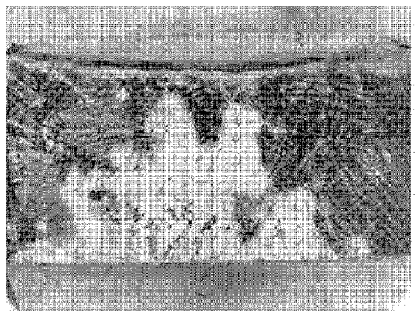
Figure 5C:
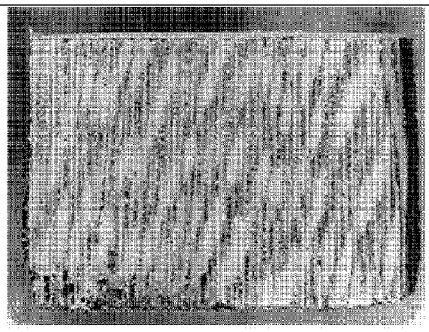
Figure 5C:
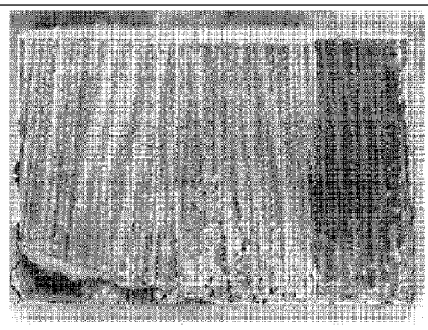

FIGS. 5A to 5C are optical microscope photographs showing the axial cross-sections of the samples treated under the above-described three conditions, respectively. First, it can be seen from FIG. 5A showing the sample treated by applying no pressure under the first condition that the one-directional solidified structure collapsed, since the process temperature was higher than the liquidus temperature. In this case, it can be seen that the sample treated at a temperature of 1330° C. maintained its original shape rather than the sample treated at a temperature of 1340° C. Moreover, it can be seen from FIG. 5B showing the sample treated under the second condition that a one-directional solidified structure of the sample processed at a temperature of 1340° C. collapsed, while the sample processed at a temperature of 1340° C. maintained its original one-directional solidified structure except for the periphery thereof. It can be seen from FIG. 5C showing the same treated under the third condition, where the temperature and pressure were increased simultaneously, that the sample maintained its one-directional solidified structure irrespective of the process temperature. From the above results, it can be expected that the material behavior of the Ni-based superalloy on which the HIP process is performed becomes quite different from that of the Ni-based superalloy provided at an atmospheric pressure. In the event that the temperature and pressure are simultaneously increased during the HIP process, it can be seen from the DTA graph of FIG. 4 that the HIP process may be performed even at a solidus temperature above 1200° C.

Example 2

First HIP Process Test

Figure 1A:
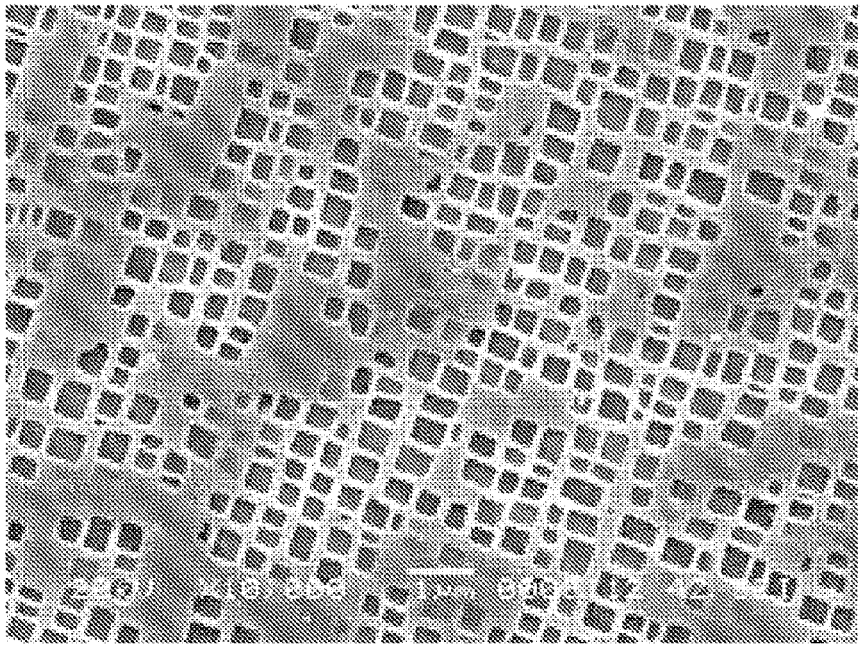
FIG. 1A (RELATED ART)
FIGS. 1A and 1B are scanning electron microscope (SEM) photographs showing dendritic microstructures and interdendritic microstructures, respectively, of Ni-based superalloy components treated with a conventional heat treatment.
Figure 1B:
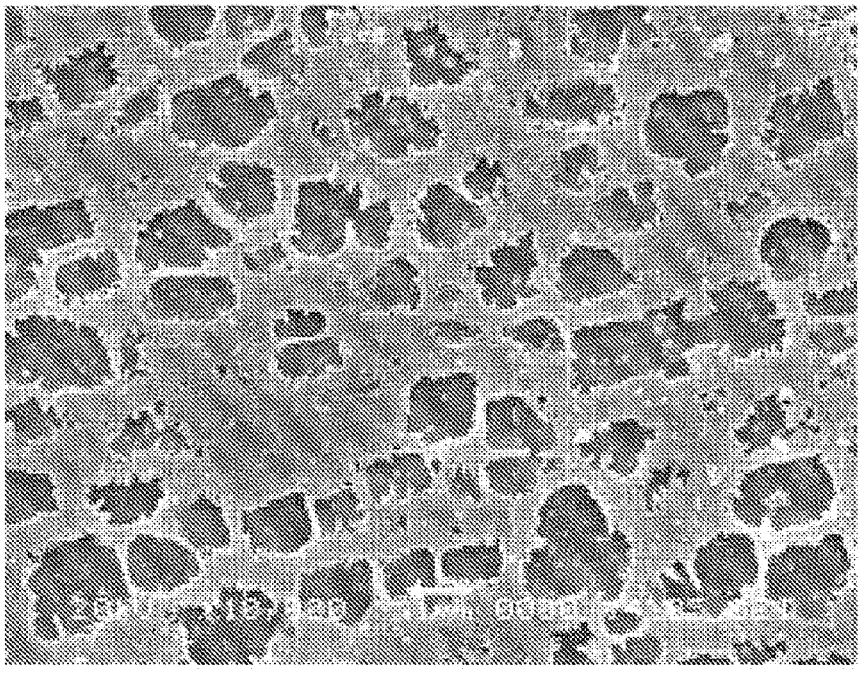
FIG. 1B (RELATED ART)
Figure 2A:
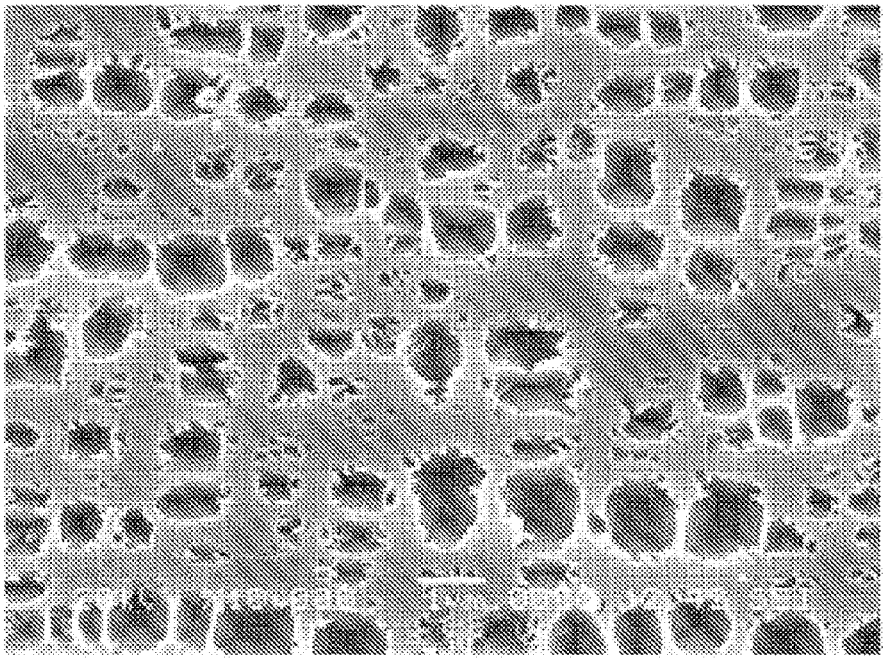
FIG. 2A (RELATED ART)
FIG. 2A is an SEM photograph showing microstructures of a Ni-based superalloy component that is used over a long period.
Figure 2B:
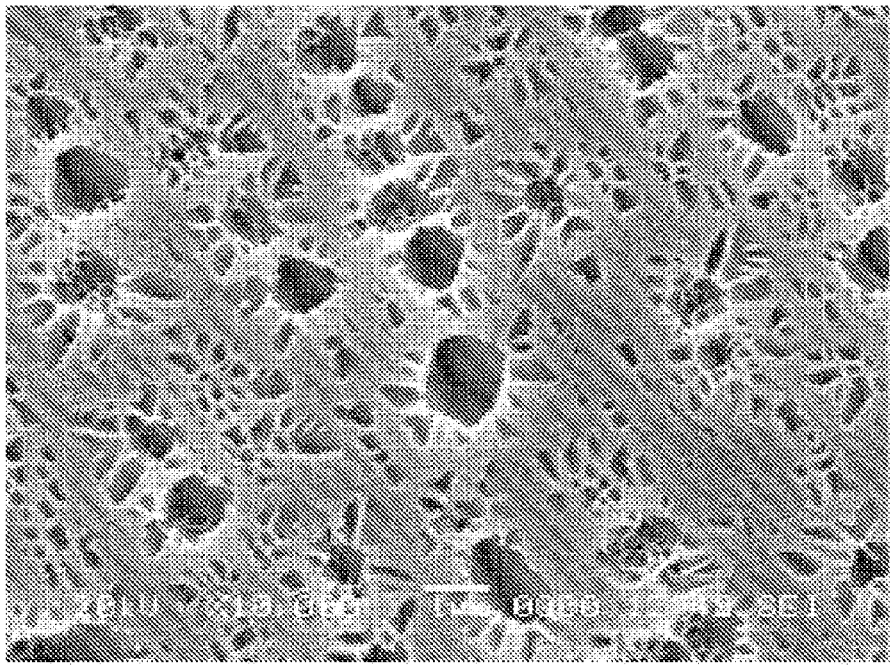
FIG. 2B (RELATED ART)
FIG. 2B is an SEM photograph showing microstructures of a Ni-based superalloy component that is treated with a commercially available hot isostatic pressing (HIP) process.
Figure 6A:
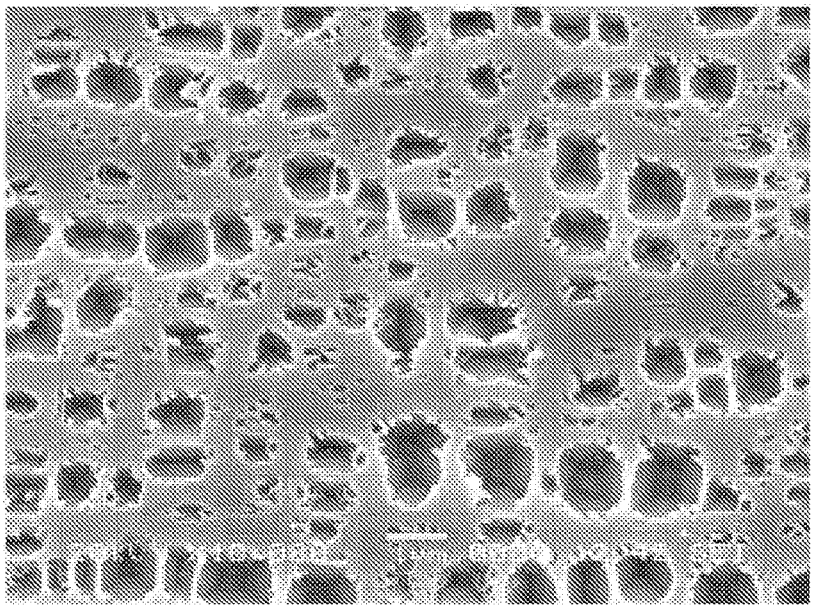
FIGS. 6A and 6B are SEM photographs showing the cross-sections of dendritic microstructures and interdendritic microstructures formed of GTD-111 DS after performing an aging treatment according to Example 2.
Figure 6B:
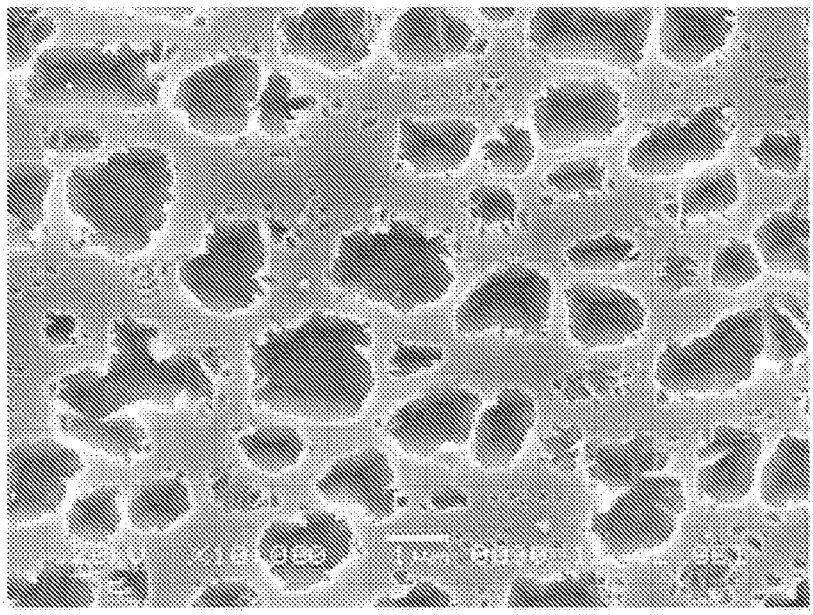

The rod-shaped samples, precisely cast in the same manner as Example 1, were processed at a temperature of about 1190° C. for 4 hours, at a temperature of about 1120° C. for 2 hours, and at a temperature of about 845° C. for 24 hours, respectively, to obtain microstructures as shown in FIGS. 1A and 1B. In order to reproduce an aged structure of a gas turbine, the thus prepared samples were processed at a temperature of 1110° C. for 70 hours to obtain aged structures as shown in FIGS. 6A and 6B.

In the present Example, the HIP process was performed on the aged samples at a temperature of about 1190° C. at a pressure of 120 MPa for 4 hours. Moreover, the aged samples were heated, pressurized, cooled and exhausted under the conditions shown in Table 3, and the changes made to the aged samples were examined. The aged samples were heated at a rate of about 150° C./min. After performing the HIP process, the aged samples were furnace-cooled at a rate of about 10° C./min.

Referring to FIGS. 1A and 1B, it can be seen that the dendritic γ' precipitation phases have size and shape different from those of the interdendritic γ' precipitation phases. The dendritic γ' precipitation phases have square shapes, while the interdendritic γ' precipitation phases are considerably large-sized and irregularly shaped. The structures shown in FIGS. 1A and 1B are very similar to those obtained by processing GTD-111 at a temperature of 1200° C. for 4 hours, at a temperature of 1120° C. for 2 hours, and then at a temperature of 845° C. for 24 hours by Sajjadi et al. [S. A. Sajjadi, S. M. Zebarjad, R. I. L. Guthrie, M. Isac, J. Mater. Process. Technol. in press].

TABLE 3

HIP process conditions according to Example 2

| Sample No. | Process conditions | Remark |
|---|---|---|
| AR | Precision casting and heat treatment | |
| AG | Aging treatment | Aged AR |
| 1H00 | HIP process under atmospheric pressure | HIPed AG |
| 1H11 | Program 1 + 3 | HIPed AG |
| 1H12 | Program 1 + 4 | HIPed AG |
| 1H21 | Program 2 + 3 | HIPed AG |
| 1H22 | Program 2 + 4 | HIPed AG |

Program 1: The samples were heated to a temperature of about 1190° C. and pressurized to a pressure of about 120 MPa simultaneously, and maintained for 4 hours.

Program 2: The samples were heated to a temperature of about 1190° C., maintained for 10 minutes, pressurized to a pressure of 120 MPa for 70 minutes, and maintained for 4 hours.

Program 3: The samples were furnace-cooled and exhausted at the same time.

Program 4: While maintaining the pressure of 120 MPa, the samples were furnace-cooled to a temperature of about 900° C. and exhausted.

FIGS. 6A and 6B are SEM photographs showing the cross-sections of the AG sample obtained by aging the sample AR at a temperature of about 1100° C. for 74 hours. Referring to FIGS. 6A and 6B, it can be seen that the precipitation phases were grown in dendrites and interdendritic regions. Referring to FIG. 6A, the dendritic precipitation phases were seriously deformed and generally rounded. The precipitation phases are changed from typical square shapes to circular shapes in the same way as in the case where a gas turbine blade is used at high temperatures for a long time [J.-C. Chang, Y.-H. Yun, C. Choi and J.-C. Kim, Engineering Failure Analysis 10 (2003) 559-56, P. D. Genereux, D. F. Paulonis, in: S. Reichman, D. N. Duhl, G. Maurer, S. Antolovich, C. Lund (Eds.), Processing of 1High Strength Superalloy Components from fine Grain Ingot in Superalloys (1988) 535-544].

So far, the influence of the HIP process on the shapes of the precipitation phases has been examined based on the results shown in FIGS. 1 and 6, of which the results are illustrated in FIGS. 7A to 7D.

Figure 7A:
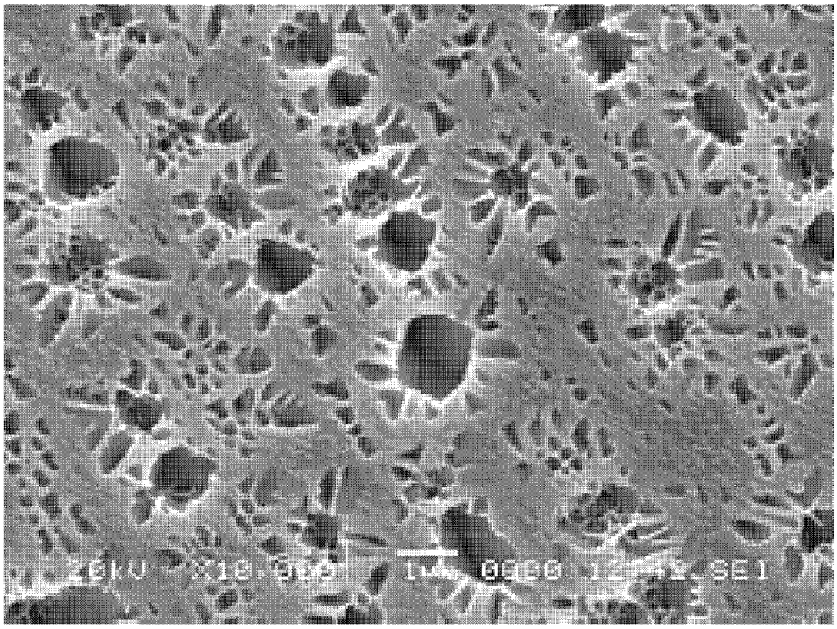
FIGS. 7A to 7D are SEM photographs showing the cross-sections of microstructures of GTD-111 DS dendritic central portions treated under HIP conditions according to Example 2.

First, referring to FIG. 7A, the simplest sample 1H11 was obtained using an HIP process under the conditions where the temperature and pressure were increased simultaneously, maintained for a predetermined time, and lowered simultaneously. While lowering the pressure, the pressure reached an atmospheric pressure at a very high rate. It seems that the HIP process as described with reference to FIG. 7A is most commercially available. Referring to FIG. 7A, the precipitation phases have about the same size and shape as those of the AG sample shown in FIG. 6A and are uniformly distributed in dendrites. Some small precipitation phases were completely dissolved and precipitated near the precipitation phases that are not yet dissolved.

Figure 7B:
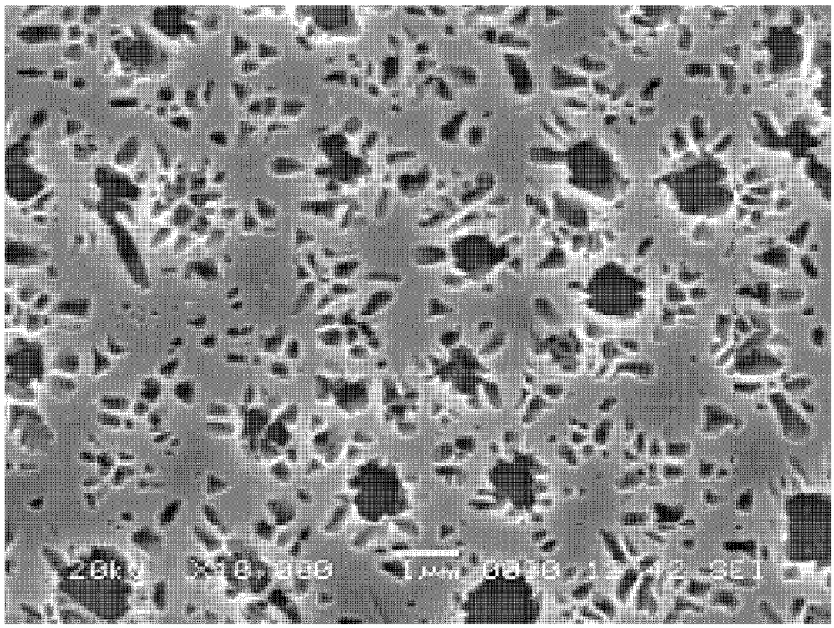

FIG. 7B is a SEM photograph of the sample 1H21. Unlike the sample 1H11, the sample 1H21 was heated to a predetermined temperature by applying no pressure, maintained for 10 minutes, and then pressurized. With such pressurization at time intervals, it can be expected that elements accelerating the precipitation phases can diffuse farther. Referring to FIG. 7B, the small-sized precipitation phases in vicinity of the large-sized precipitation phases are irregularly distributed, which may be caused by the pressurization at time intervals. However, upon comparison of the sample 1H21 of FIG. 7B with the sample 1H11 of FIG. 7A, there is little difference. That is, it can be understood that the HIP process has little influence under the above temperature condition.

Figure 7C:
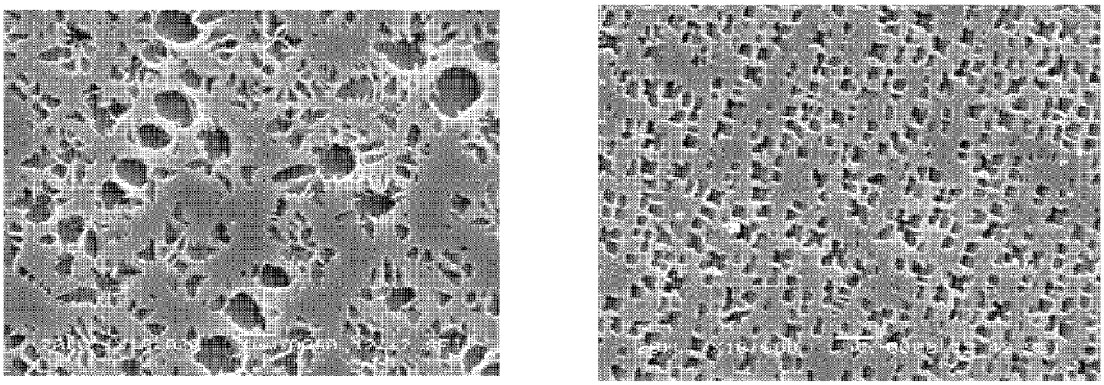
Figure 7D:
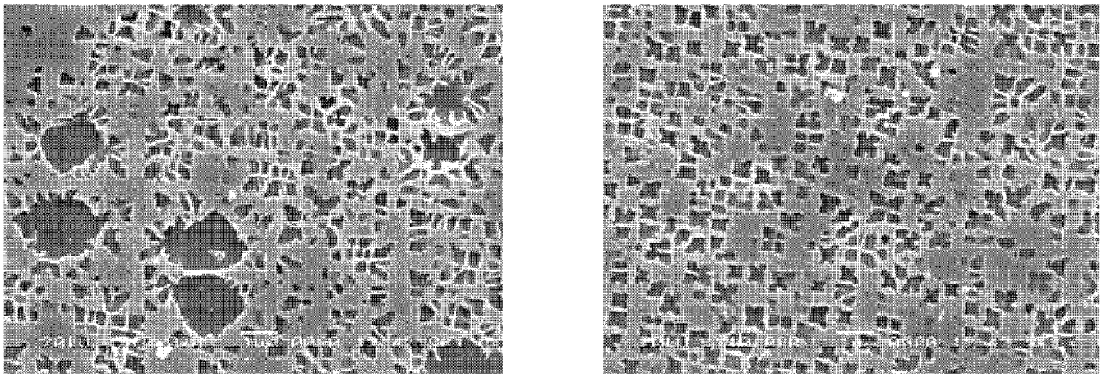

Meanwhile, in the event that the pressure was reduced at predetermined time intervals in the same manner as the samples 1H12 and 1H12, different results were obtained as shown in FIGS. 7C and 7B. When the samples 1H12 and 1H22 were subjected to the HIP process, the samples were maintained for a predetermined time, furnace-cooled to a temperature of about 900° C. while maintaining the pressure, and then decompressed to an atmospheric pressure. Referring to FIGS. 7C and 7D, the dendritic precipitation phases are irregularly shaped and minute precipitation phases are mixed with large ones. The area including the minute precipitation phases is wider in the sample 1H22 than in the sample 1H12. Although the large precipitation phases have a size of about 3 to 4 μm, they are distributed at a very low density in the sample 1H22. From a comparison between the precipitation phases shown in FIGS. 7A and 7B and those shown in FIGS. 7C and 7D, the effects of the high pressure on the cooling process can be inferred. With the action of the high pressure, the growth of precipitation phases is inhibited during the cooling process, thus causing the formation of the minute precipitation phases. Similarly, it is reported that the microstructures of an Al53 at. % Ge alloy become finer at a high pressure [K. Kimura and S. Yamaoka, Materials Science and Engineering A 387-389 (2004) 628-632].

Example 3

Second HIP Process Test

Figure 8A:
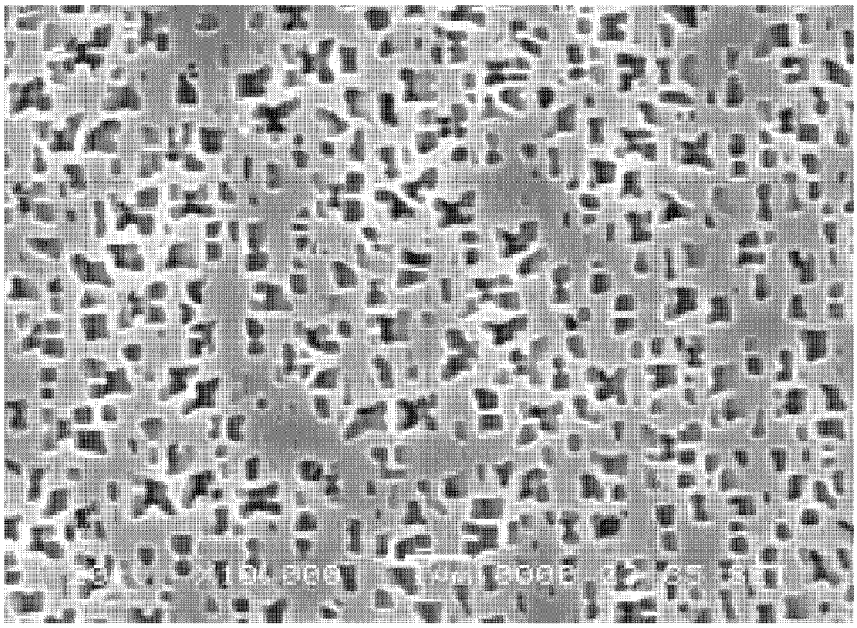
FIGS. 8A to 8D are SEM photographs showing the cross-sections of microstructures of GTD-111 DS dendritic central portions treated under HIP conditions according to Example 3.
Figure 8B:
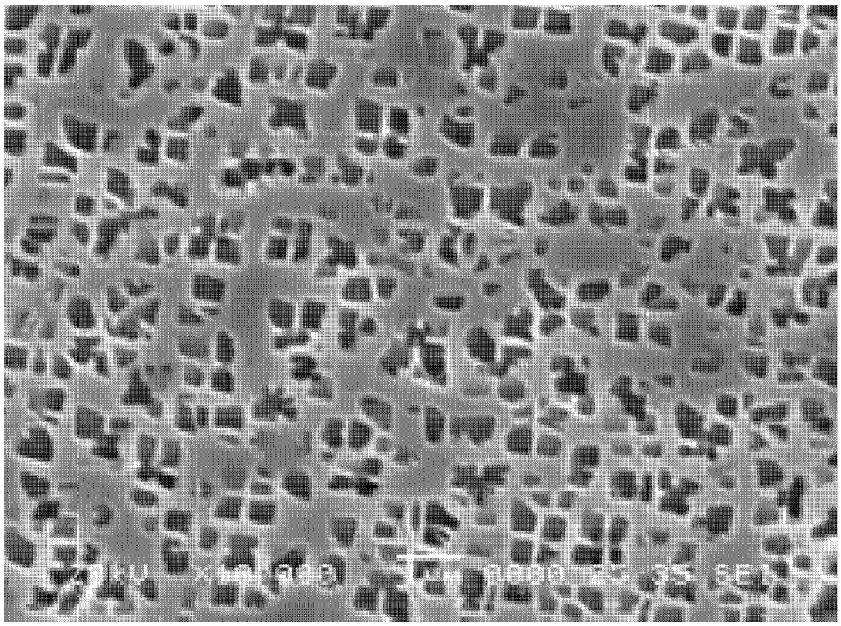
Figure 8C:
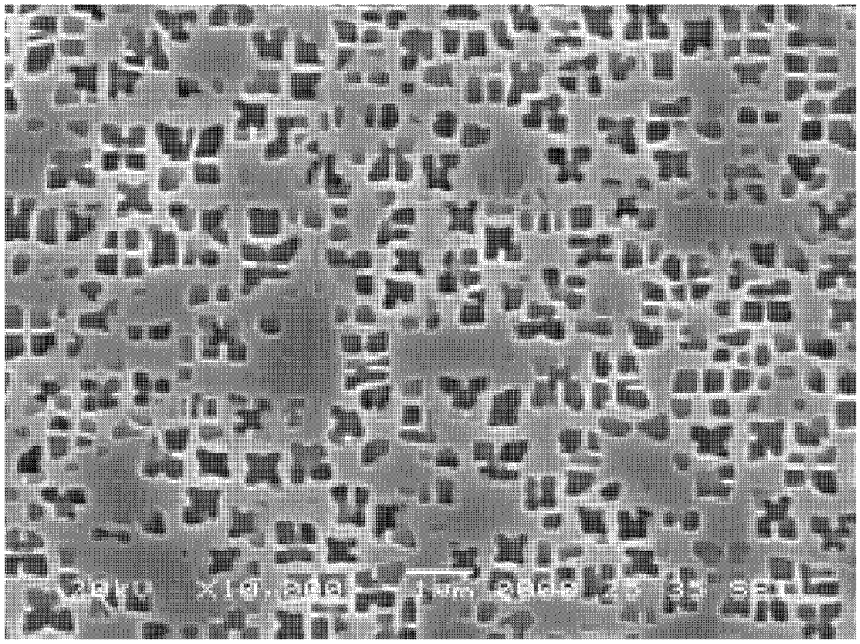
Figure 8D:
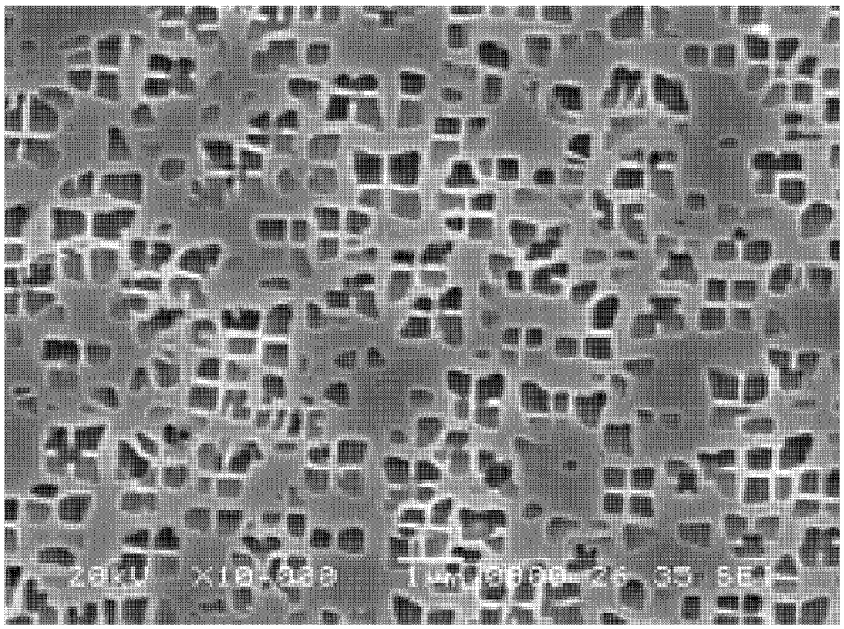
Figure 9A:
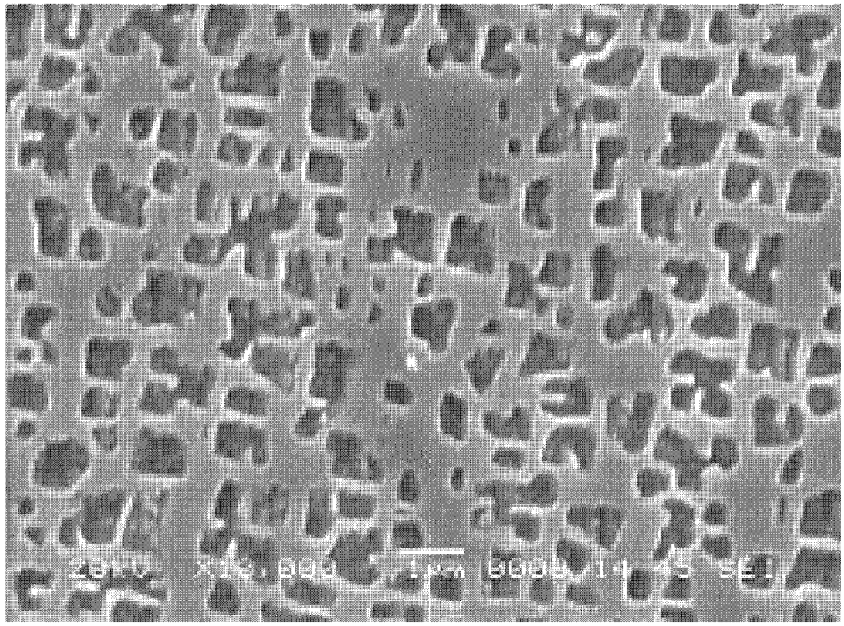
FIGS. 9A to 9D are SEM photographs showing the cross-sections of microstructures of GTD-111 DS dendritic central portions treated under HIP conditions according to Example 4.
Figure 9B:
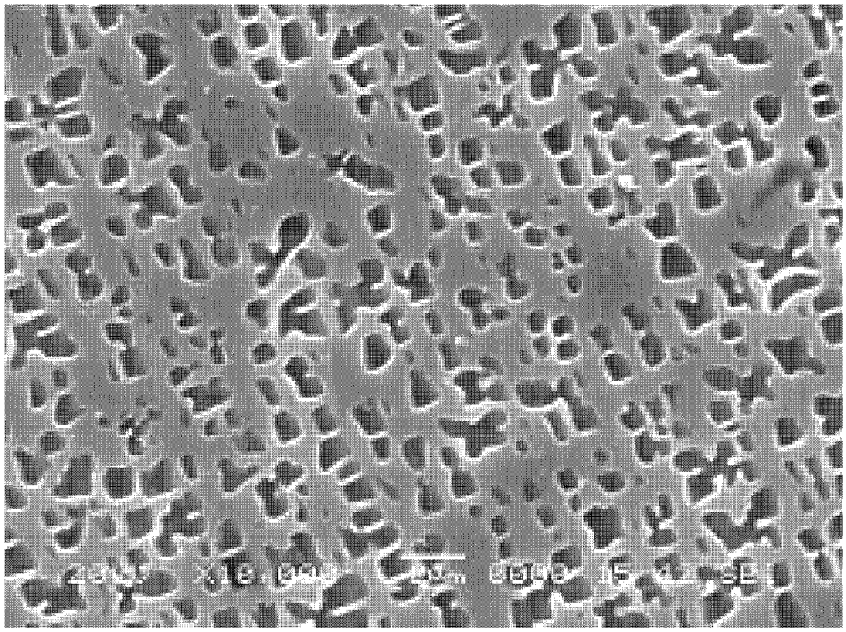
Figure 9C:
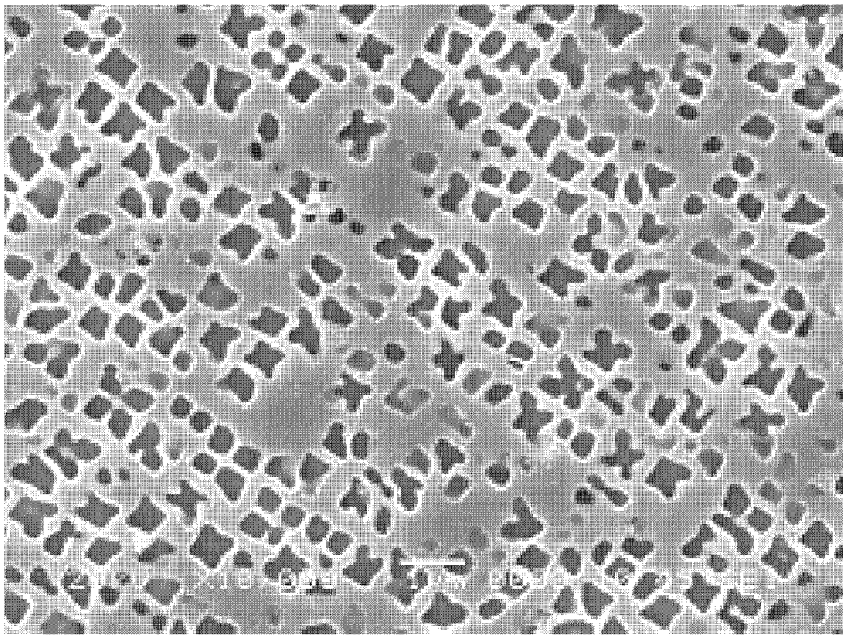
Figure 9D:
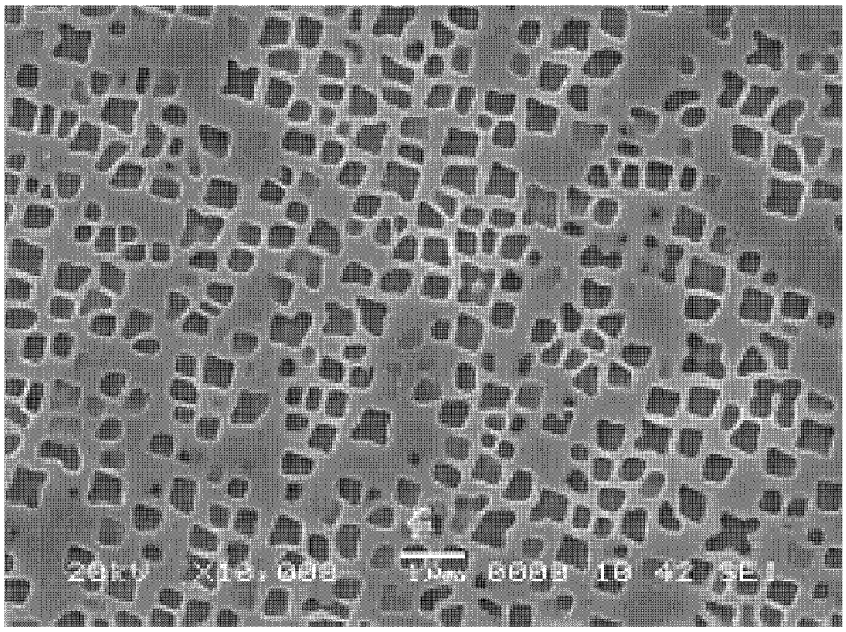

In the present Example, the HIP process was performed under the same conditions as in Example 2, except that the process temperature was raised from 1190° C. to 1230° C., and the general changes in microstructures were observed. Detailed processing conditions are shown in Table 4. Referring to FIG. 8A, the microstructures of the sample 2H11 were generally uniformized compared with those of the sample AR or the sample 1H11. There was little difference between the dendrites and interdendritic regions, and the interdendritic γ' precipitation phases became minute. Such a difference was made by an HIP process temperature of about 1230° C., which is much higher than a melting temperature of a γ–γ' process as shown in the DTA graph of FIG. 4. Accordingly, there is a possibility that the precipitation phases may be dissolved in the base material at this temperature. However, as illustrated above, it is expected that the precipitation phases are not completely dissolved due to the high-pressure effect. All the samples processed in the present Example showed about the same results. However, referring to the high magnification photographs of FIGS. 8A to 8D, slight differences among the samples can be observed. Generally, the distribution and shape of the precipitation phases of the samples 2H11, 2H21, 2H12, and 2H22 are about the same as in portions where fine precipitation phases are concentrated in the samples 1H12 and 1H22 of FIG. 7. Accordingly, it can be understood that the precipitation phases of the samples processed at a temperature of 1230° C. were mostly dissolved and re-precipitated. Referring to FIGS. 8A to 8D, the size and distribution of the precipitation phases were generally similar, but the samples 2H21, 2H12, and 2H22 had precipitation phases larger than those of the sample 2H11. The sample 2H11 had precipitation phases of about 0.3 μm or less, while the sample 2H22 had precipitation phases of about 0.4 μm. The precipitation phases of the samples 2H12 and 2H21 had intermediate sizes between the sizes of the precipitation phases of the samples 2H11 and 2H22. Thus, it can be ascertained that when maintaining the pressure during the cooling process, the precipitation and growth of γ' phases were accelerated due to the small volume of the γ' phases. However, since alloy elements diffuse at low speed under a high pressure, it is expected that the growth of the alloy elements is limited to below a predetermined size. As a result of measuring the area percent (%) (i.e., volume percent) of the precipitation phases from the photographs of the samples 2H12, 2H21, 2H12, and 2H22, the precipitation phases had 25% or less, which is far lower than 31% of the precipitation phases of the sample AR shown in FIGS. 1A and 1B.

TABLE 4

HIP process conditions according to Example 3

| Sample No. | Process conditions | |
|---|---|---|
| 2H11 | Maintained at 1230° C. | Other conditions are same as sample 1H11 |
| 2H12 | Maintained at 1230° C. | Other conditions are same as sample 1H12 |
| 2H21 | Maintained at 1230° C. | Other conditions are same as sample 1H21 |
| 2H22 | Maintained at 1230° C. | Other conditions are same as sample 1H22 |

Example 4

Third HIP Process Test

In the present Example, in order to obtain the precipitation phases having the same size and area percent (%) as the precipitation phases of the sample AR shown in FIGS. 1A and 1B, the process temperatures were varied as shown in Table 5, and the thus obtained microstructures of the samples were observed. In the present Example, all the samples were processed at a temperature of about 1230° C. for the first 2 hours, and the process temperature was varied from 1000 to 1090° C. for the next 2 hours. Also, the sample 2H21-1050*np* was maintained at a pressure of 120 MPa for the first 2 hours and processed at an atmospheric pressure for the next 2 hours. FIGS. 9A to 9D are SEM photographs of dendritic microstructures of samples 3H12-1090, 3H21-1000, 3H21-1020, and 3H21-1050*np*. Referring to FIGS. 9A to 9D, it can be seen that the higher the process temperature of the latter half process was, the larger the size of γ' precipitation phases became. When the process temperature at which the latter half process was given in the range of 1000 to 1090° C., the size of the γ' precipitation phases was ranged from 0.3 to 0.7 μm. When the samples were processed at a temperature of about 1020° C., the size of the γ' precipitation phases was 0.4 μm, which is the same as in the sample AR shown in FIGS. 1A and 1B. The volume percent (%) of the precipitation phases was measures as 24 to 28% at a temperature of 1000° C., 27 to 32% at a temperature of 1020° C., 33 to 34% at a temperature of 1050° C., and 31 to 33% at a temperature of 1090° C.

TABLE 5

| HIP process conditions according to Example 4 | | |
|---|---|---|
| Sample No. | Process conditions | Remark |
| 3H12-1090 | Heated to 1230° C. and pressurized to 120 MPa simultaneously and maintained for 2 hours; furnace-cooled to 1090° C. while maintaining pressure of 120 MPa and maintained for 2 hours; furnace-cooled to 850° C.; and then exhausted | |
| 3H21-1000 | Heated to 1230° C. and maintained for 10 min; pressurized to 120 MPa and maintained for 2 hours; furnace-cooled to 1000° C. while maintaining pressure of 120 MPa and maintained for 2 hours: and then furnace-cooled and exhausted simultaneously | |
| 3H21-1020 | Maintained at 1020° C. for 2-hour latter half process | Other conditions are same as sample 3H21-1000 |
| 3H21-1050np | Heated to 1230° C. and maintained for 10 min; pressurized to 120 MPa and maintained for 2 hours; exhausted and furnace-cooled to 1050° C. simultaneously and maintained for 2 hours; and then furnace-cooled | Maintained under atmospheric pressure for 2-hour latter half process |

Example 5

Fourth HIP Process Test

Figure 10A:
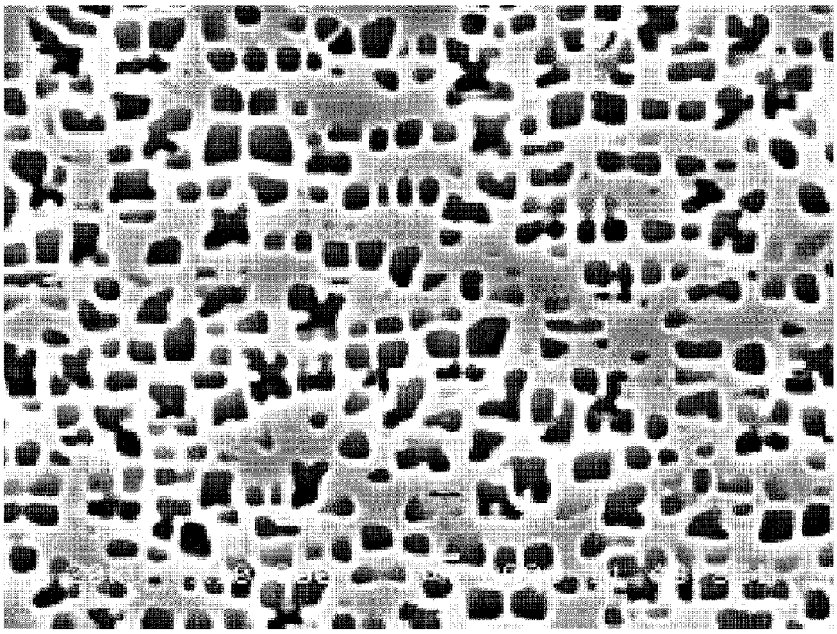
FIGS. 10A and 10B are SEM photographs showing the cross-sections of microstructures of GTD-111 DS dendritic central portions treated under HIP conditions according to Example 5.
Figure 10B:
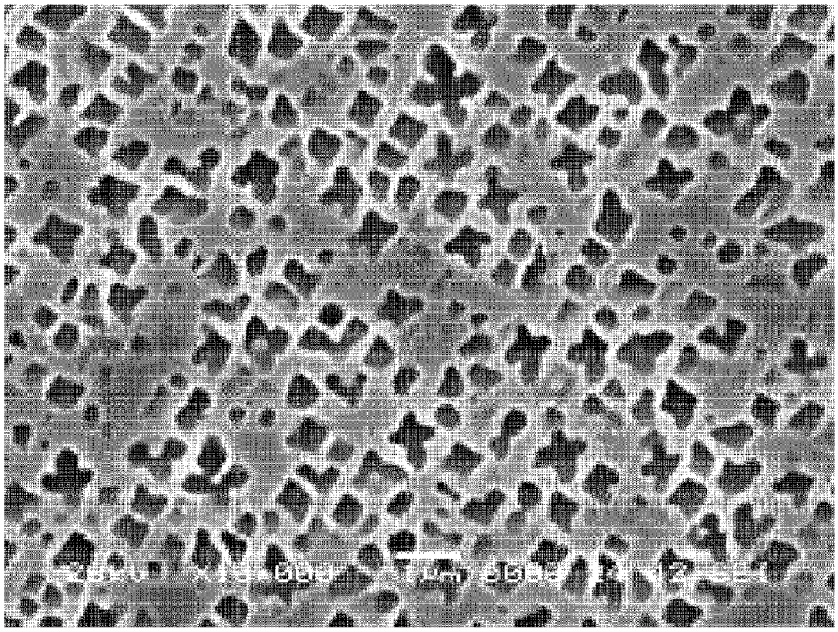

In order to find out the process conditions under which the precipitation phases have about the same size and volume percent (%) as the precipitation phases of the sample AR shown in FIGS. 1A and 1B, on which a standard heat treatment was performed, based on the results of Example 4, an HIP process was performed by varying the process temperature three times as shown in Table 6. The 2-hour latter half HIP process was performed at a temperature of 1040° C., which is intermediate between 1020° C. and 1050° C., and the 2-hour HIP process was further performed at a temperature of about 900° C. in order to additionally precipitate fine γ' phases. As shown in FIGS. 10A and 10B, the precipitation phases had generally the same size as the precipitation phases of the sample 3H21-1050*np* shown in FIG. 9D. As compared with the dendritic precipitation phases of GTD-111 DS of FIGS. 1A and 1B on which a standard heat treatment was performed, the precipitation phases of samples 4H11-1040 and 4H12-1040 had very irregular shapes, but they had about the same size and volume percent of about 32%.

TABLE 6

| HIP process conditions according to Example 5 | |
|---|---|
| Sample No. | Process conditions |
| 4H11-1040 | Heated to 1230° C. and pressurized to 120 MPa simultaneously and maintained for 2 hours; furnace-cooled to 1040° C. while maintaining pressure of 120 MPa and maintained for 2 hours; exhausted and furnace-cooled to 900° C. simultaneously and maintained for 2 hours; and then furnace-cooled |
| 4H12-1040 | Heated to 1230° C. and pressurized to 120 MPa simultaneously and maintained for 2 hours; furnace-cooled to 1040° C. while maintaining pressure of 120 MPa and maintained for 2 hours; furnace-cooled to 900° C. and maintained for 2 hours; and then exhausted and furnace-cooled simultaneously |

Example 6

Fifth HIP Process Test

In the present Example, the HIP process was performed under the same conditions as in Example 5, except that an initial process temperature was elevated to 1240° C. and all samples were processed for a total of 6 hours by varying the process temperature three times. Particularly, the HIP process was performed at a temperature of 1240° C. for the first 2 hours, at a temperature of 1030° C. for the next 2 hours, and at a temperature of 890 to 900° C. for the last 2 hours, and the changes in the overall microstructures of the samples were observed. Detailed process conditions are shown in Table 7.

Figure 11A:
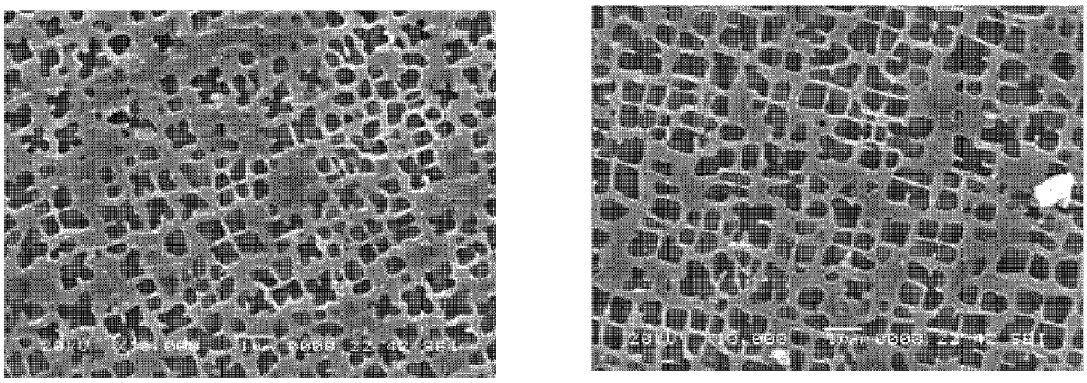
FIGS. 11A and 11B are SEM photographs showing the cross-sections of dendritic and interdendritic microstructures of GTD-111 DS treated under HIP conditions according to Example 6.
Figure 11B:
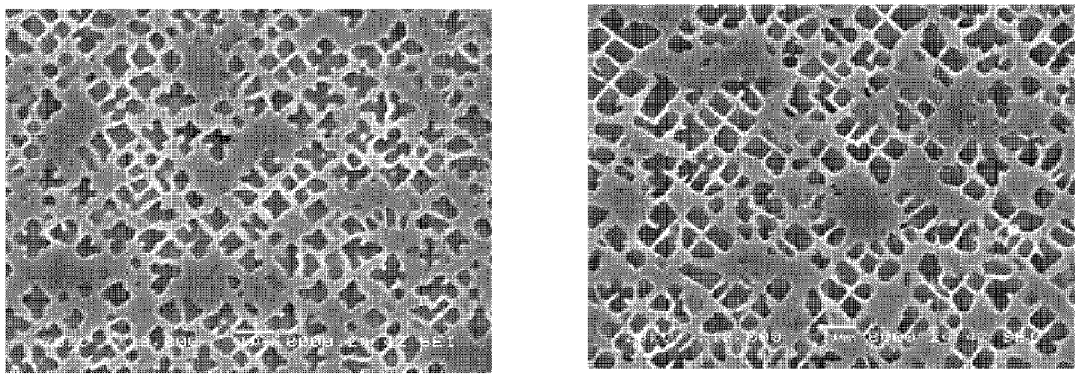

FIGS. 11A and 11B are SEM photographs showing the cross-sections of microstructures of samples according to the present Example. Here, the photographs on the left show the dendritic central portions of the microstructures, while the photographs on the right show the interdendritic portions thereof. Unlike in the sample AR shown in FIGS. 1A and 1B, there was little difference between the dendritic central portions and the interdendritic portions, and γ' precipitation phases of the interdendritic portions also were fine. This difference between the sample AR shown in FIGS. 1A and 1B and the samples shown in FIGS. 11A and 11B was due to the HIP temperature of about 1240° C., which is about the same as the temperature of 1230° C.

TABLE 7

| HIP process conditions according to Example 6 | |
|---|---|
| Sample No. | Process conditions |
| 5H11-1030 | Heated to 1240° C. and pressurized to 120 MPa simultaneously and maintained for 2 hours; furnace-cooled to 1030° C. while maintaining pressure of 120 MPa and maintained for 2 hours; exhausted and furnace-cooled to 890° C. simultaneously and maintained for 2 hours; and then furnace-cooled |
| 5H12-1030 | Heated to 1240° C. and pressurized to 120 MPa simultaneously and maintained for 2 hours; furnace-cooled to 1030° C. while maintaining pressure of 120 MPa and maintained for 2 hours; furnace-cooled to 900° C. and maintained for 2 hours; and then exhausted and furnace-cooled simultaneously |

Example 7

Test of Mechanical Properties on HIP Processed Samples

In the present Example, the influence of the one-step process of HIP and heat treatment on mechanical properties was examined via high-temperature and room-temperature tensile tests and a creep-rupture test. The high-temperature tensile test was performed at a temperature of about 871° C. at a strain rate of 1 mm/min, and the creep-rupture test was performed at a temperature of about 871° C. at a pressure of 372 Mpa.

Figure 12:
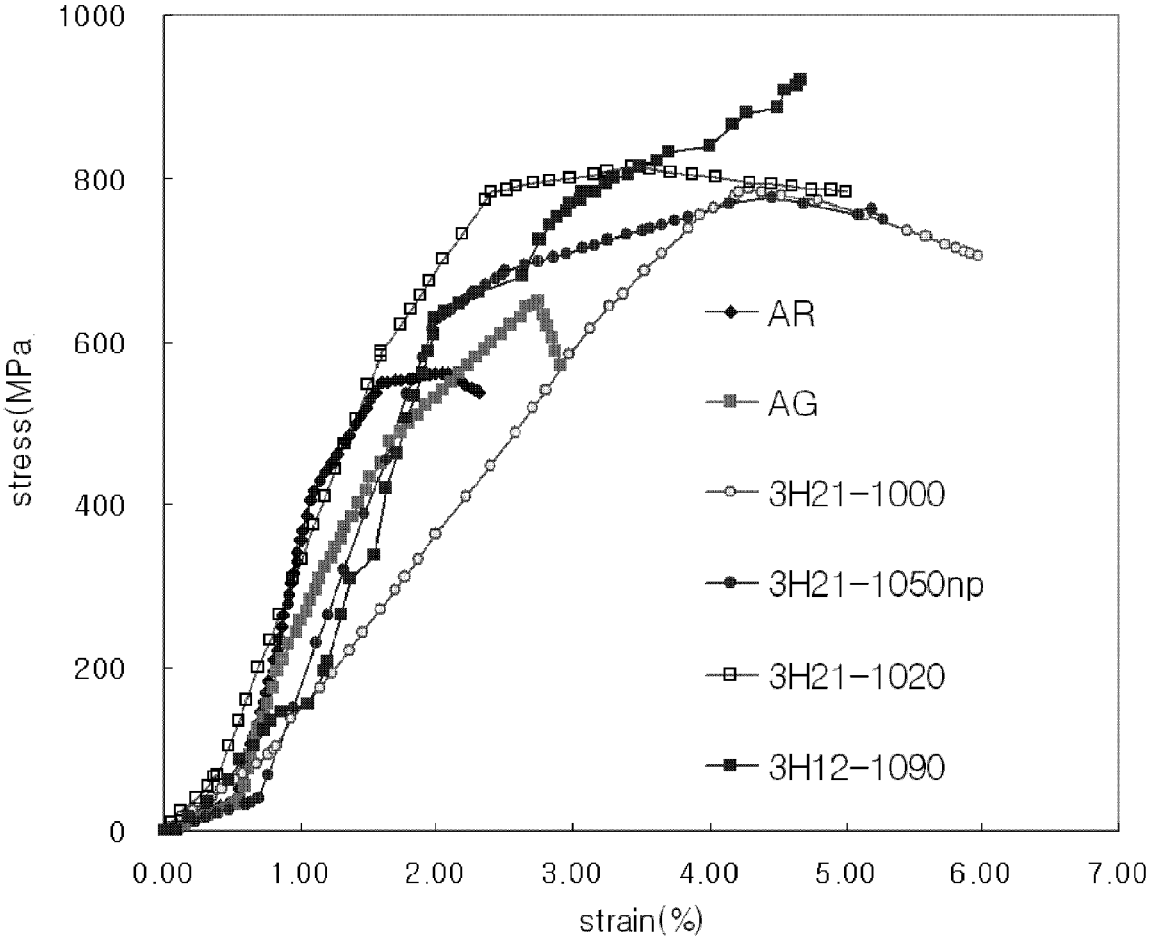
FIG. 12 is a graph showing stress-strain curves of samples treated under the same HIP conditions as those of Example 4.

The results of the high-temperature tensile test performed on the samples treated according to Example 4 are shown in Table 8 and FIG. 12. Referring to Table 8, it can be seen that ultimate tensile stress (UTS) and yield stress (YS) values of all the samples processed using the HIP process are higher than those of the samples AR and AG. Moreover, in view of the various HIP process conditions, it can be seen that if the temperature at which γ' phases are precipitated increased from 1000° C. to 1090° C., the UTS and YS values also became higher. Such characteristics correspond with the size, volume %, and trend of the precipitation phases located on the microstructures shown in FIGS. 9A to 9D. In particular, the volume % of the precipitation phases of the sample according to Example 4 was measured as 24 to 28% at a temperature of 1000° C., 27 to 32% at a temperature of 1020° C., and 31 to 33% at a temperature of 1090° C. Meanwhile, in the case of the sample 3H-1050*np*, the precipitation phases had the highest volume % of 33 to 34% and the largest size smaller than that of the sample 3H-1090, but they had the lowest physical property values. Accordingly, it can be seen that, if γ' phases are precipitated at a high pressure, the physical properties of the γ' phases can be greatly improved. Referring to FIG. 12, which shows the stress-strain curves of the samples processed according to Example 4, the sample 3H12-1090 has the highest UTS and YS values, but has little ductility. In this respect, since the sample 3H12-1020 has very high UTS and YS values and an appropriate ductility, it can be confirmed that the sample 3H12-1020 was desirably processed.

TABLE 8

Results of the high-temperature tensile test at 871° C. (1600° F.) on the samples processed according to Example 4

| Sample No. | U.T.S. (ultimate tensile stress) | Y.S. (yield stress) |
|---|---|---|
| AR | 562 | 497 |
| AG | 647 | 521 |
| 3H12-1000 | 786 | 708 |
| 3H12-1020 | 814 | 773 |
| 3H12-1090 | 920 | 798 |
| 3H12-1050np | 775 | 692 |

The results of the tensile and creep-rupture tests performed on the samples processed according to Examples 5 and 6 are shown in Table 9. Upon comparison of 0.2% YS values measured at room temperature in Table 9, the 0.2% YS values of all the samples processed using an HIP process were slightly lower than the 0.2% YS value of the sample AR treated using the standard heat treatment, but they generally exceed 90%. In particular, the sample 5H11-1030 had a 0.2% YS value of 99.2%, which is about the same as that of the sample AR. Upon comparison of UTS values measured at room temperature, irrespective of HIP process conditions, the UTS values of all the samples processed using the HIP process were about the same as or slightly more than the UTS value of the sample AR. Upon comparison of 0.2% YS values measured via the high-temperature tensile test, like in the room temperature tensile test, the 0.2% YS values of all the samples processed using the HIP process were slightly lower than the 0.2% YS value of the sample AR processed using the standard heat treatment, but they generally exceed 90%. In particular, the sample 5H11-1030 had a 0.2% YS value of 97.2%. In the case of UTS values measured at a high temperature, irrespective of HIP process conditions, the UTS values of all the samples processed using the HIP process were about the same as the UTS value of the sample AR. In view of the elongation, the room temperature elongations of the samples processed using the HIP process were 10 to 30% higher than that of the sample AR. However, the high temperature elongation of the sample 5H11-1030 was about 80% that of the sample AR. As a whole, it can be confirmed that the sample 5H11-1030 showed about the same physical property values as the sample AR.

When observing the microstructures under the various HIP-heat treatment conditions, marked differences that affect mechanical properties cannot be found. As illustrated above, when γ' phases are precipitated at a high pressure, the physical properties of the γ' phases can be greatly improved. However, since the γ' phases of the 4H- and 5H-series samples were mostly precipitated at a high pressure, it is assumed that there was only a little difference in physical properties between the γ' phases of the 4H- and 5H-series samples. However, since the sample 5H11-1030 was processed at an atmospheric pressure for the last 2 hours, it is decided that minute changes were made to the structures and the changes led the elongation of the sample 5H11-1030 to approximate that of the sample AR.

TABLE 9

Results of the high-temperature (871° C.) tensile test and creep-rupture test (rupture time of aged sample: 20.4 h) on the samples processed according to Examples 5 and 6

| HIP process | Test temperature (° C.) | 0.2% Y.S. (MPa) | UTS (MPa) | Elongation (%) | Modulus (GPa) | Rupture time (hour) |
|---|---|---|---|---|---|---|
| AR | 871 | 786.8 | 1037 | 13.35 | 20.5 | 59.1 (18.2) |
| | Room temperature | 890.9 | 1062 | 10.08 | 37.57 | |
| 4H12-1040 | 871 | 721.2 | 1040 | 9.962 | 30.51 | 66.0 |
| | | 703.2 | 974 | 8.608 | 29.53 | 38.1 |
| | Relative value to AR % | 90.5 | 97.1 | 69.6 | 146.4 | 112 |
| | Room temperature | 793.1 | 1038 | 14.19 | 37.22 | — |
| | | 822.3 | 1082 | 12.76 | 31.74 | — |
| | Relative value to AR (%) | 90.7 | 99.8 | 133.7 | 91.8 | — |
| 5H12-1030 | 871 | 723.3 | 1125 | 11.73 | 30.41 | 54.0 |
| | | 728.4 | 914 | 7.124 | 17.29 | 62.7 |
| | Relative value to AR (%) | 92.3 | 98.3 | 70.6 | 116.3 | 106 |

TABLE 9-continued

Results of the high-temperature (871° C.) tensile test and creep-rupture test (rupture time of aged sample: 20.4 h) on the samples processed according to Examples 5 and 6

| HIP process | Test temperature (° C.) | 0.2% Y.S. (MPa) | UTS (MPa) | Elongation (%) | Modulus (GPa) | Rupture time (hour) |
|---|---|---|---|---|---|---|
| | Room temperature | 853.3 | 1138 | 13.26 | 35.66 | — |
| | | 840.9 | 1088 | 12.29 | 37.3 | — |
| | Relative value to AR (%) | 95.1 | 104.8 | 126.7 | 97.1 | — |
| 5H11-1030 | 871 | 760.9 | 1117 | 12.19 | 28.62 | 68.8 |
| | | 769.1 | 1107 | 9.022 | 30.98 | 34.0 |
| | Relative value to AR (%) | 97.2 | 107.2 | 79.4 | 145.4 | 116 |
| | Room temperature | 884.1 | 1064 | 9.99 | 36.46 | — |
| | | 882.6 | 1086 | 11.4 | 35.64 | — |
| | Relative value to AR (%) | 99.2 | 101.2 | 106.1 | 96.0 | — |

Based on the results obtained in Example 7, the temperature of the HIP process comprises three stages. Based on the DTA data shown in FIG. 4, it is preferable that the temperature of the first-stage of the HIP process be about 1210 to 1250° C., that of the second-stage be about 1000 to 1200° C., and that of the third-stage be about 850 to 900° C.

In the case where the temperature of the HIP process is too low, the material to be processed cannot ensure sufficient ductility and, if the pressure of the HIP process is too low, the material to be processed cannot ensure sufficient stress to cure fine cracks. Moreover, as can be seen from the DTA data of FIG. 4, if the temperature of the HIP process is above 1250° C., the base material partially melts to deteriorate its own properties. Furthermore, if the pressure of the HIP process is too high, the stability of the HIP apparatus may be adversely affected.

The Ni-based superalloy component according to the present invention may be formed of 10 to 20% by weight of Cr, 5 to 15% by weight of Co, 1 to 6% by weight of Al, 1 to 6% by weight of Ti, 0 to 5% by weight of W, 0 to 4% by weight of Ta, 0 to 3% by weight of Mo, small percentages by weight of C, Fe, and B, and the remaining percentage by weight of Ni.

According to the present invention as described above, an HIP process and a heat treatment process, which have been conventionally separately performed to manufacture or repair a Ni-based superalloy component for a gas turbine, are performed as a one-step process using an HIP process. As a result, defects, such as micropores or microcracks, which are caused when casting, welding, or brazing the Ni-based superalloy component for a gas turbine, can be effectively cured and the physical properties of the Ni-based superalloy component can be optimized through the heat treatment process.

Moreover, with the one-step process of HIP and heat treatment, it is possible to simplify the process of manufacturing and repairing the Ni-based superalloy component and reduce the unit cost of the component.

Furthermore, since the heat treatment process can be performed at a high pressure, the physical properties of the Ni-based superalloy component can be improved compared with the typical heat treatment Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. A method of manufacturing a Ni-based superalloy component suitable for a gas turbine, the method comprising simultaneously performing a hot isostatic pressing (HIP) process and a heat treatment process as a one-step process on a Ni-based superalloy using an HIP apparatus under pressure to produce the Ni-based superalloy component, wherein the simultaneous HIP process and heat treatment process is performed at a first temperature of from about 1210° C. to about 1250° C., said first temperature being below an incipient melting temperature of the Ni-based superalloy, and a first pressure of 1000 atm to 1500 atm for 1-3 hours and then a second temperature of from about 1000° C. to about 1090° C., said second temperature being below γ' solvus of the Ni-based superalloy, and a second pressure of 1000 atm to 1500 atm for 1-3 hours.

* * * * *